US005239351A

United States Patent [19]

Mahoney

[11] Patent Number: 5,239,351

[45] Date of Patent: Aug. 24, 1993

[54] REPRODUCTION APPARATUS HAVING AN ADJUSTABLE DETACK ROLLER ASSEMBLY

[75] Inventor: Gregory P. Mahoney, Fairport, N.Y.

[73] Assignee: Eastman Kodak Company, Rochester, N.Y.

[21] Appl. No.: 942,917

[22] Filed: Sep. 10, 1992

[51] Int. Cl.[5] ..... G03G 21/00

[52] U.S. Cl. ..... 355/315; 355/271; 355/309; 271/307

[58] Field of Search ..... 355/309, 315, 321, 271; 271/307-308

[56] References Cited

U.S. PATENT DOCUMENTS

| | | | |
|---|---|---|---|
| 4,257,700 | 3/1981 | Tsuda et al. | 355/271 X |
| 4,269,504 | 5/1981 | Landa | 271/308 X |
| 4,410,262 | 10/1983 | Ariyama et al. | 355/315 |
| 4,461,468 | 7/1984 | Peter, III et al. | 271/308 |
| 4,766,459 | 8/1988 | Jinbo et al. | 355/315 |
| 5,055,876 | 10/1991 | Matsuoka | 355/309 X |
| 5,153,656 | 10/1992 | Johnson | 355/271 X |

FOREIGN PATENT DOCUMENTS

| | | | |
|---|---|---|---|
| 2547807 | 5/1976 | Fed. Rep. of Germany | 271/174 |

*Primary Examiner*—A. T. Grimley
*Assistant Examiner*—Matthew S. Smith
*Attorney, Agent, or Firm*—Tallam I. Nguti

[57] ABSTRACT

A reproduction apparatus having a flexible web member and detack roller assembly that includes a plurality of rotatable rollers over each of which a copy sheet and the flexible web member (while in intimate contact), can be trained. The plurality of detack rollers include a first, small diameter roller for forming a small web-wrap angle and a large sheet separation angle, and a second, larger diameter roller for forming a relatively larger web-wrap angle and a relatively smaller sheet separation angle. The first and second rollers are mounted on a frame for selective indexing into training engagement with the flexible web member.

6 Claims, 2 Drawing Sheets

REPRODUCTION APPARATUS HAVING AN ADJUSTABLE DETACK ROLLER ASSEMBLY

BACKGROUND OF THE INVENTION

1. Technical Field

This invention relates to electrostatographic reproduction apparatus which produce transferable toner images on a movable dielectric member. More particularly, this invention relates to such a reproduction apparatus having an endless web dielectric member and a adjustable detack roller assembly.

2. Background Art

Electrostatographic reproduction apparatus are well known which each have an imaging member such as an endless dielectric rigid drum or flexible web member. Each also includes subsystems for forming transferrable toner images on the dielectric member, and a subsystem for transferring the toner images to a copy sheet that is fed into intimate and image-transfer relation with the dielectric member. Each copy sheet after receiving the transferred image is separated or stripped from the dielectric member for subsequent fusing of the toner images on the copy sheet.

As disclosed for example in U.S. Pat. No. 4,410,262, issued Oct. 18, 1983 to Ariyama et al, the process of separating or stripping a copy sheet from the dielectric member (just after toner images have been transferred to the copy sheet) is critical and can result in image defects if not handled properly. Where the dielectric member is a rigid drum, it is known, as discussed in the Ariyama et al patent (above), to use sheet-stripping fingers, or sheet pick-off belts to separate the copy sheet from the rigid drum. Where the dielectric member is a flexible web or belt, it is known to train a portion of the web over what is referred to as a "detack roller" (at the point where copy sheets are to be separated or stripped from the web).

The use of a "detack roller" to strip copy sheets as such presents a set of conflicting objectives and problems. Separating a copy sheet using a detack roller relies in great part on the beam strength of the copy sheet. The process essentially entails moving both the copy sheet and flexible web about the detack roller such that the web alone is wrapped around the detack roller with the expectation that the copy sheet (because of its beam strength) will remain in a tangential path to the detack roller. The copy sheet will thus be forced to separate at a particular separation angle from the web. As such, the larger the separation angle, the sharper it is, and the easier the separation of the sheet from the web, even for lightweight, low-beam strength copy sheets. Therefore, reducing the size or diameter of the detack roller improves such separation because it increases the sharpness of the sheet separation angle.

Unfortunately, however, decreasing the size or diameter of the detack roller as such undesirably tends to result in a bending or "core-setting" of the flexible web during periods when the reproduction apparatus is idle with the flexible web wrapped around such a small diameter roller. Such undesirable bending or core-setting can result in subsequent image formation defects as well as in early failure or deterioration of the web itself.

SUMMARY OF THE INVENTION

It is, therefore, an object of the present invention to provide for use in a reproduction apparatus having an endless web dielectric member, an adjustable detack roller assembly that facilitates copy sheet separation, but which substantially avoids undesirable bending or "core-set" in the dielectric member.

In accordance with the present invention, such a detack roller assembly comprises a plurality of rotatable rollers over each of which a flexible web, with a copy sheet in intimate contact, can be selectively trained. The plurality of detack rollers include a first roller for forming a small web-wrap angle, defining a large sheet separation angle, and a second roller for forming a bigger web-wrap angle and a smaller sheet separation angle. The plurality of rollers is mounted such that they are indexable relative to a path of movement of the web, and such that during operating periods of the reproduction apparatus the first roller can be selectively indexed into engagement with the web, but such that during shut-down or idle periods of the reproduction apparatus, the second roller is indexed into such engagement with the web.

BRIEF DESCRIPTION OF THE DRAWINGS

In the detailed description of the invention presented below, reference is made to the drawings, in which.

DETAILED DESCRIPTION OF THE INVENTION

Because electrostatographic reproduction machines are well known, the present description will be directed in particular to elements thereof which form part of or cooperate more directly with the present invention. Elements thereof not specifically shown or described herein are assumed selectable from those known in the prior art.

Figure 1:
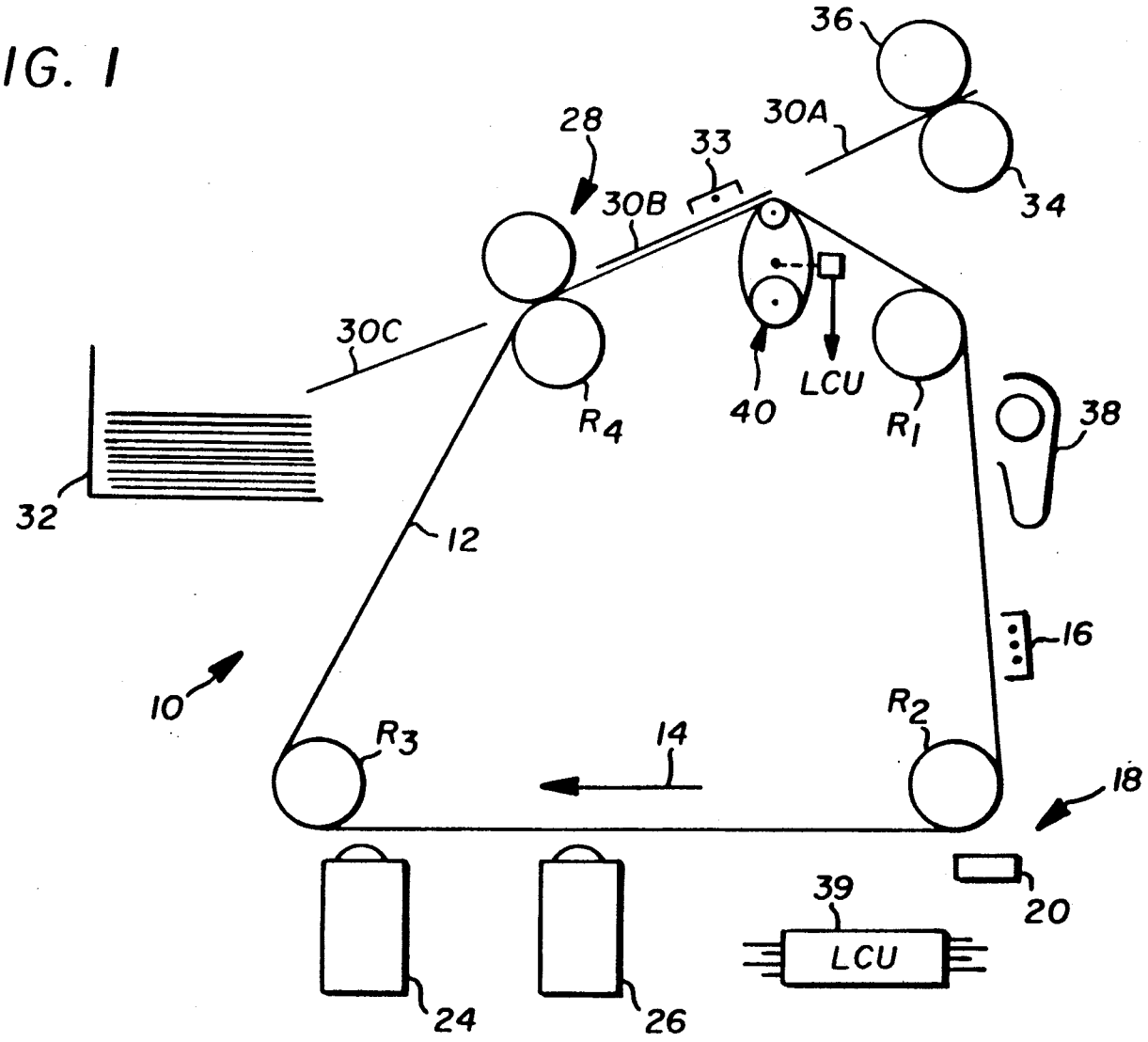
FIG. 1 is a schematic illustration of an exemplary reproduction apparatus having an endless web dielectric member and the detack roller assembly of the present invention.

Referring to FIG. 1, an electrostatographic document reproduction apparatus 10 such as a copier or printer has a dielectric image forming and image transfer member such as a flexible photo-conductive belt or web 12. As shown, the flexible web 12 is trained over a series of rotatable rollers including the rollers $R_1$, $R_2$, $R_3$ and $R_4$, and is moved by suitable drive means (not shown) in a clockwise direction as represented by an arrow 14.

A charging station 16 applies an electrostatic charge to the surface of the photo-conductive web or belt 12. At an exposure station 18, projected light, from a write head 20 for example, imagewise dissipates electrostatic charge on the surface of the web 12 in order to form a latent electrostatic image corresponding to the image of an original to be copied or printed. Write head 20 preferably has an array of light-emitting diodes (LEDs) for exposing the photoconductive belt, but it is to be understood that other technologies for imagewise exposure, for example optical technologies, are equally applicable.

The latent electrostatic image on the surface of the web 12 is developed with toners at development stations 24 and 26 to form a toner image. As the toner image on web 12 approaches a transfer station 28, an image receiver sheet 30 (shown at sequential stages as 30A, 30B, 30C) is fed from a supply 32 for receiving such image. After transfer of the toner image to the receiver sheet, the receiver sheet is then separated or stripped from the web 12 with the aid of the detack roller assembly of the present invention designated generally by the numeral 40 (to be described in detail below). A detack charger 33 reduces the level of charges tending to hold the copy sheet, such as the sheet 30B, to the surface of the web 12. Following separation from the surface of the web 12, the copy sheet, for example the sheet 30A is passed through a pair of heated fuser rollers 34 and 36 for fusing and fixing the toner image to the receiver sheet. Mechanical and electrical cleaning of belt 12 is effected at a cleaning station 38 in preparation for the formation and transfer of another toner image. As is well known in the art, the operation and sequencing of the stations and components of the reproduction apparatus 10 are controlled by a logic and control unit (LCU) shown as 39.

Figure 2:
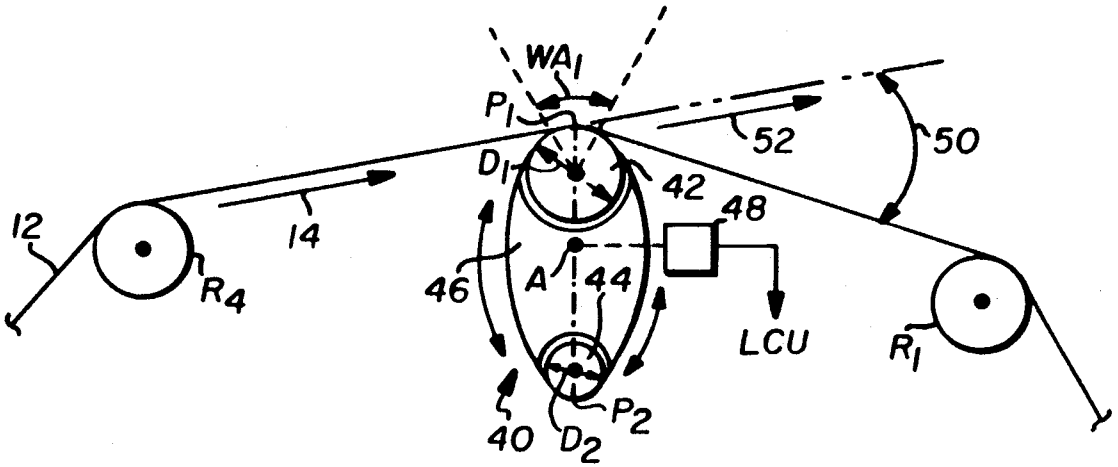
FIG. 2 is an enlarged view of the copy sheet detack region of the reproduction apparatus of FIG. 1 and showing the orientation of the detack roller assembly of the present invention during an idle or shut-down period thereof.

Referring now to FIGS. 2 an 3, an enlarged portion of the reproduction apparatus 10 including the detack roller assembly 40 of the present invention is shown. The detack roller assembly 40 is useful for rotatably training and supporting the flexible web 12 so as not to create or form an undesirable bend or "core-set" in the web 12. The detack roller assembly 40 is also useful for creating a sharp bend in the direction of movement of the flexible web 12, as trained thereover, so as to cause a copy sheet on the web 12 to be easily separated or stripped from the web.

Accordingly, the detack roller assembly 40 comprises a plurality of rotatable detack rollers including a first detack roller 42 and a second detack roller 44 rotatably supported by a frame 46 so that they are spaced about 180° from each other. The frame 46 is mounted for selective indexing by a drive means 48 connected to the LCU 39 for locating either the first detack roller 42 or the second detack roller 44 in engagement with the flexible web 12. As shown, the first roller 42 has a diameter $D_1$ and the second roller 44 has a diameter $D_2$ such that $D_1$ is substantially greater than $D_2$. As such, the first roller 42 with the larger diameter provides a large wrap angle WA1 (FIG. 2), and is particularly useful for supporting the flexible web 12 during shut-down or non-operating periods in order to effectively prevent undesirable bending or "core-set" in the member 12. The diameter $D_1$ for example should preferably be selected to be substantially the same or close to the diameters of the other training rollers $R_1$, $R_2$, $R_3$ and $R_4$.

As shown in FIG. 2, a large diameter roller such as the roller 42 forms a large web-wrap angle $WA_1$ and a sheet separation angle shown as 50 for causing a copy sheet on the web 12 to separate (at a detack point along the path of the web 12) from the web 12 and move in the direction shown by the arrow 52. The large web-wrap angle $WA_1$ operates to prevent "core-set" as discussed above. The sheet separation angle 50, however, is still significantly large enough to cause particularly heavier weight, high beam strength copy sheets to separate from the web 12 over the first, larger detack roller 42. As such, the first, larger roller 42 is useful for supporting the web or member 12 during shut-down periods and for training the web or member 12 during operating periods when such high beam strength copy sheets are being supplied from the source 32. When using the larger detack roller 42 operatively as such, a tension roller, for example $R_1$, can be adjusted to take up any variation in the path of the web or member 12.

Figure 3:
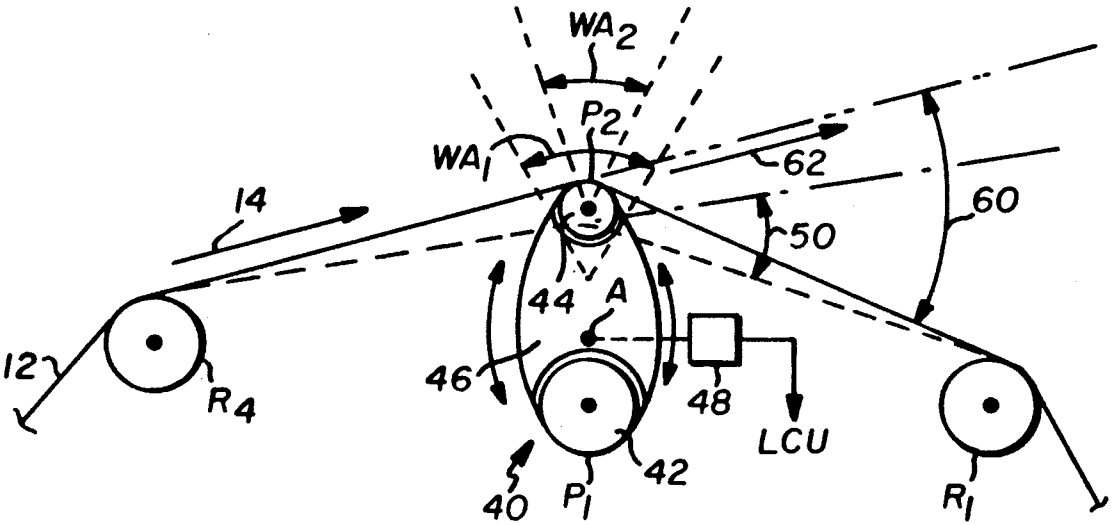
FIG. 3 is an enlarged schematic view similar to that of FIG. 2 of the copy sheet detack region of the reproduction apparatus of FIG. 1 showing the orientation of the detack roller assembly of the present invention during a run period of the reproduction apparatus.

Preferably, however, as shown in FIG. 3, the detack roller assembly 40 should be selectively indexed 180°, when going from a shut-down period to an operating period, so as to bring the second, smaller diameter roller 44 into engagement (along the cross-track line of detack of the path of the web 12) with the web 12. As shown, the smaller roller 44 forms a small web-wrap angle $WA_2$ with the web 12 and a significantly larger sheet separation angle 60 for causing even lightweight, low beam strength copy sheets to separate from the web 12 moving in the direction of the arrow 62. The reproduction apparatus 10 can be set up so that the operating length and path of the web 12 is as defined partially by the second, smaller roller 44 (FIG. 3), or as it is shown in FIG. 2. As stated above, a tension roller, such as $R_1$, can be utilized to compensate for any variation in the path length of the web 12. In either case, it is preferable that during shut-down periods, the detack roller assembly 40 should be selectively indexed so as to bring the first, larger diameter roller 42 into engagement with the web 12 in order to prevent "core set" in the web.

As shown in the FIGS. 1–3, the first and second detack rollers 42, 44 are mounted on the common frame 46 so as to be spaced about 180° from each other. The frame 46 is indexable by the drive means 48 about a fixed axis A. The axis A is located such that a first distance from the axis A through the center of the first roller 42 to a first point $P_1$ on the surface of the first roller 42 is less than a second distance from the axis A through the center of the second roller 44 to the second point $P_2$ on the surface of the second roller 44.

The invention has been described in detail with particular reference to a presently preferred embodiment, but it will be understood that variations and modifications can be effected within the spirit and scope of the invention.

What is claimed is:

1. A detack roller assembly for use in a reproduction apparatus having a flexible image-carrying member to support a portion of the image-carrying member and to separate copy sheets from the image-carrying member, the detack roller assembly comprising:

(a) a first rotatable detack roller, having a first predetermined diameter, for engaging the backside surface of the flexible image-carrying member along a detack line in a path of the image-carrying member;

(b) a second rotatable detack roller, having a second predetermined diameter different from said first predetermined diameter of said first rotatable detack roller, for engaging the backside surface of the flexible image-carrying member along substantially said detack line in the path of the image-carrying member; and (c) means for selectively indexing said first rotatable detack roller and said second rotatable detack roller and into engagement with the backside surface of the flexible image-carrying member.

2. The detack roller assembly of claim 1 wherein said diameter of said first detack roller is greater than said diameter of said second roller.

3. The detack roller assembly of claim 2 wherein said selective indexing means includes a common indexable frame for mounting said first and said second detack rollers.

4. The detack roller assembly of claim 3 wherein said common frame has a fixed indexing axis and a first distance from said axis through the center of said first detack roller to a line on the surface- of said first detack roller is less than a second distance from said axis through the center of said second detack roller to a line on the surface of said second detack roller.

5. The detack assembly of claim 3 wherein said second detack roller is mounted on said indexable frame spaced about 180° from said first detack roller.

6. A reproduction apparatus comprising:

(a) a flexible image-carrying member for forming developed images for transfer to a receiver sheet;

(b) means for forming developed images on said flexible image-bearing member during a run period of the reproduction apparatus;

(c) an adjustable detack roller assembly including a first detack roller for engaging said flexible image-carrying member during run periods of the reproduction apparatus to form a sharp receiver sheet separation angle therein, and a second roller for engaging said flexible image-carrying member during idle periods of the reproduction so as to prevent core set in the flexible image-carrying member.

* * * * *